US011364514B2

(12) United States Patent
Motowaki

(10) Patent No.: US 11,364,514 B2
(45) Date of Patent: Jun. 21, 2022

(54) DISCHARGE APPARATUS AND INDUSTRIAL ROBOT

(71) Applicant: FANUC CORPORATION, Yamanashi (JP)

(72) Inventor: Yoshio Motowaki, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 152 days.

(21) Appl. No.: 16/799,471

(22) Filed: Feb. 24, 2020

(65) Prior Publication Data

US 2020/0269270 A1 Aug. 27, 2020

(30) Foreign Application Priority Data

Feb. 26, 2019 (JP) ..... JP2019-032803

(51) Int. Cl.
*B05B 15/531* (2018.01)
*B05B 1/14* (2006.01)
(Continued)

(52) U.S. Cl.
CPC ..... *B05B 15/531* (2018.02); *B05B 1/12* (2013.01); *B05B 1/14* (2013.01); *B05B 13/0431* (2013.01); *B05B 13/0278* (2013.01)

(58) Field of Classification Search
USPC ..... 118/313, 315, 323, 321
See application file for complete search history.

(56) References Cited

U.S. PATENT DOCUMENTS 1,413,797 A * 4/1922 Shelor ..... B67C 3/16 141/50
9,089,864 B2 * 7/2015 Herre ..... B05B 12/149
2011/0014371 A1 1/2011 Herre et al.

FOREIGN PATENT DOCUMENTS

CN 1485145 A 3/2004
CN 103041943 A 4/2013
(Continued)

OTHER PUBLICATIONS

An Office Action mailed by China National Intellectual Property Administration dated Jan. 18, 2022, which corresponds to Chinese Patent Application No. 202010112268.X and is related to U.S. Appl. No. 16/799,471.

*Primary Examiner* — Yewebdar T Tadesse
(74) *Attorney, Agent, or Firm* — Studebaker & Brackett PC

(57) ABSTRACT

The present disclosure is intended to provide a discharge apparatus and an industrial robot, discharge apparatus having a relatively simple configuration capable of removing a remainder of a discharge material remaining in a discharge nozzle and a feeding channel, enabling cost reduction, and having a structure which is easy to clean and with which a function of preventing drips can be imparted. The discharge apparatus includes: a nozzle head having a plurality of feeding channels for feeding a discharge material, and a removal channel communicating with the feeding channels and usable for removing a remainder of the discharge material remaining in the feeding channel; a plurality of discharge nozzles configured to be attached to the nozzle head such that each of the plurality of discharge nozzles is connected to an associated one of the plurality of feeding channels; a delivery tube configured to deliver the discharge material selectively to one of the plurality of feeding channels so that the discharge material is discharged from the discharge nozzle; and a suction tube connectable to the removal channel and usable for sucking the remainder of the discharge material remaining in the feeding channel and the discharge nozzle through the removal channel.

7 Claims, 8 Drawing Sheets

(51) Int. Cl.

| | |
|---|---|
| ***B05B 1/12*** | (2006.01) |
| ***B05B 13/04*** | (2006.01) |
| ***B05B 13/02*** | (2006.01) |

(56) References Cited

FOREIGN PATENT DOCUMENTS

| | | | |
|---|---|---|---|
| CN | 105265036 | A | 1/2016 |
| CN | 106413915 | A | 2/2017 |
| GB | 148106 | A | 7/1920 |
| JP | 2016096303 | A | 5/2016 |

* cited by examiner

DISCHARGE APPARATUS AND INDUSTRIAL ROBOT

This application is based on and claims the benefit of priority from Japanese Patent Application No. 2019-032803, filed on 26 Feb. 2019, the content of which is incorporated herein by reference.

BACKGROUND OF THE INVENTION

Field of the Invention

The present disclosure relates to a discharge apparatus and an industrial robot.

Related Art

Discharge apparatuses have been commonly used as a means for providing workpieces with coating, application of an adhesive, painting, pretreatment, etc. Such a discharge apparatus is attached to an industrial robot or the like, and discharges or spouts a discharge material such as a coating material, an adhesive (adhesive material), a paint, an abrasive, and a pretreatment material (various liquids, solids (powders or particles) and gases).

For example, Patent Document 1 discloses a substrate treatment apparatus (discharge apparatus) that is arranged in the form of a ring or an arc about a preset center axis, and includes a plurality of nozzles through which a treatment liquid is discharged to a substrate, and a support arm supporting the plurality of nozzle.

Patent Document 1: Japanese Unexamined Patent Application, Publication No. 2016-096303

SUMMARY OF THE INVENTION

For example, in the case of a workpiece having a 3D shape or the like in which protrusions and recesses or tall parts are arranged complicatedly, it is difficult to provide the workpiece with a coating, application of an adhesive, painting, pretreatment, etc. in a short cycle time with efficiency, while ensuring high quality and good appearance. In addition, it is difficult to prevent a discharge material from dripping from a nozzle.

As a means for preventing such dripping, it has been proposed to impart a suck back function to a nozzle, the suck back function generating a back pressure that causes a discharge material to return from the tip of the nozzle to the inside. Such nozzles with the suck back function have been in practical use. In this case, however, there are disadvantages that the drips of the discharge material cause quality degradation of the discharge material, and that a drip prevention structure for carrying out the suck back function is complicated, leading to difficulty in cleaning and an increase in costs.

A discharge apparatus according to an aspect of the present disclosure includes: a nozzle head having a plurality of feeding channels for feeding a discharge material, and a removal channel communicating with the feeding channels and usable for removing a remainder of the discharge material remaining in the feeding channel; a plurality of discharge nozzles configured to be attached to the nozzle head such that each of the plurality of discharge nozzles is connected to an associated one of the plurality of feeding channels; a delivery tube configured to deliver the discharge material selectively to one of the plurality of feeding channels so that the discharge material is discharged from the discharge nozzle; and a suction tube connectable to the removal channel and usable for sucking the remainder of the discharge material remaining in the feeding channel and the discharge nozzle through the removal channel.

An industrial robot according to an aspect of the present disclosure includes: an arm; and the above-described discharge apparatus that is attachable to the arm.

The discharge apparatus according to the aspect of the present disclosure and the industrial robot including the discharge apparatus can enhance efficiency in working such as application of a discharge material in a liquid, solid (powder or particle) or gaseous form, such as a coating material, an adhesive (adhesive material), a paint, an abrasive, and a pretreatment material to a workpiece, and can improve the quality of the working. Using the discharge apparatus according to the aspect of the present disclosure alone makes it possible to achieve suitable automation of application of discharge materials in various forms to various types of workpieces, while eliminating the need to provide two or more apparatuses.

DETAILED DESCRIPTION OF THE INVENTION

A discharge apparatus and an industrial robot according to an embodiment will be described below with reference to FIGS. 1 to 8.

The discharge apparatus according to present embodiment is attachable to, for example, an arm (robot hand) of an industrial robot, and is configured to discharge a discharge material in a liquid, solid or gaseous form, such as a coating material, an adhesive (adhesive material), a paint, an abrasive, and a pretreatment material so as to provide a workpiece with coating, application of an adhesive, painting, polishing, pretreatment, etc.

Figure 1:
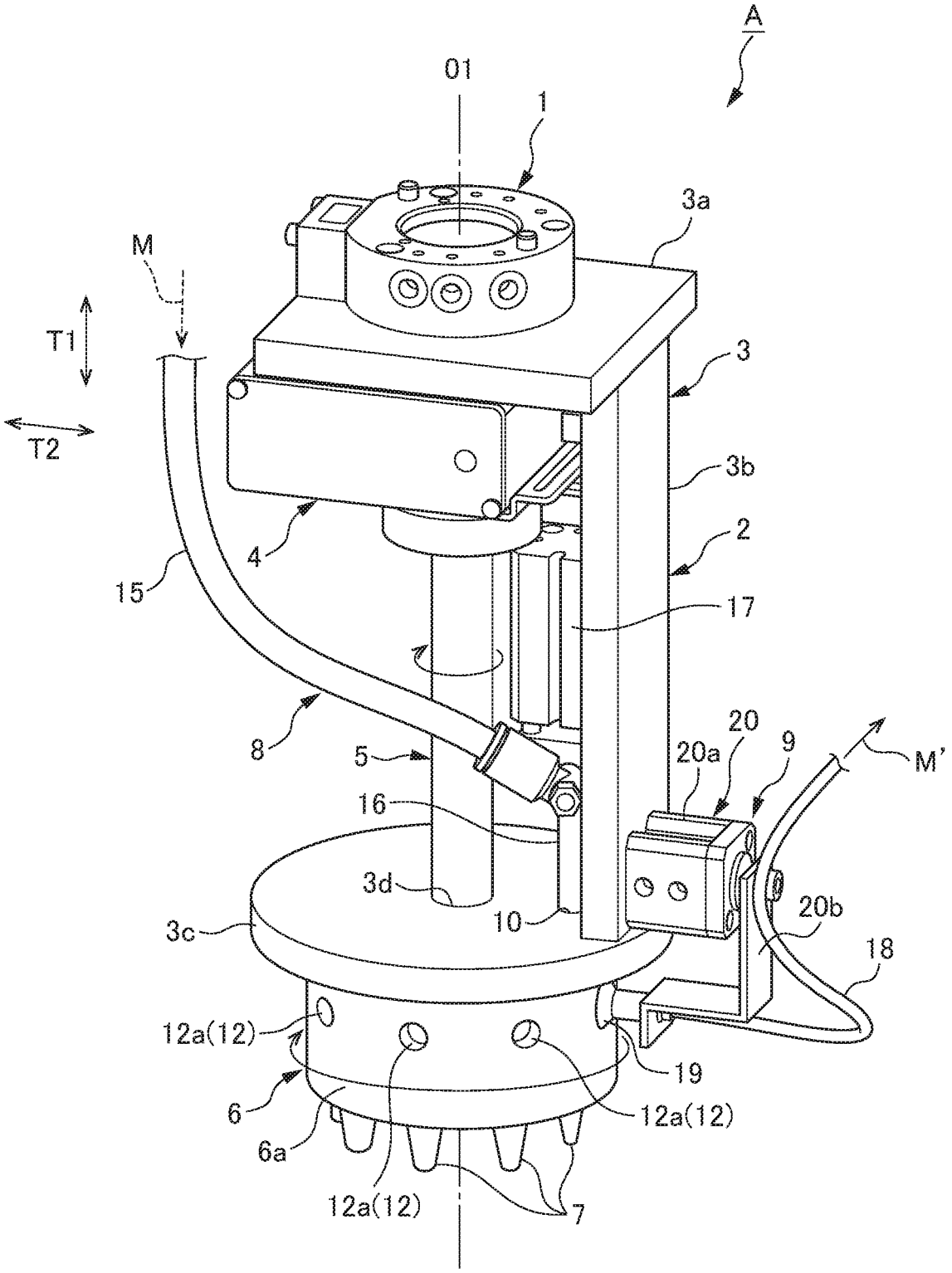
FIG. 1 is a perspective view showing a discharge apparatus according to an embodiment, as viewed from above.
Figure 2:
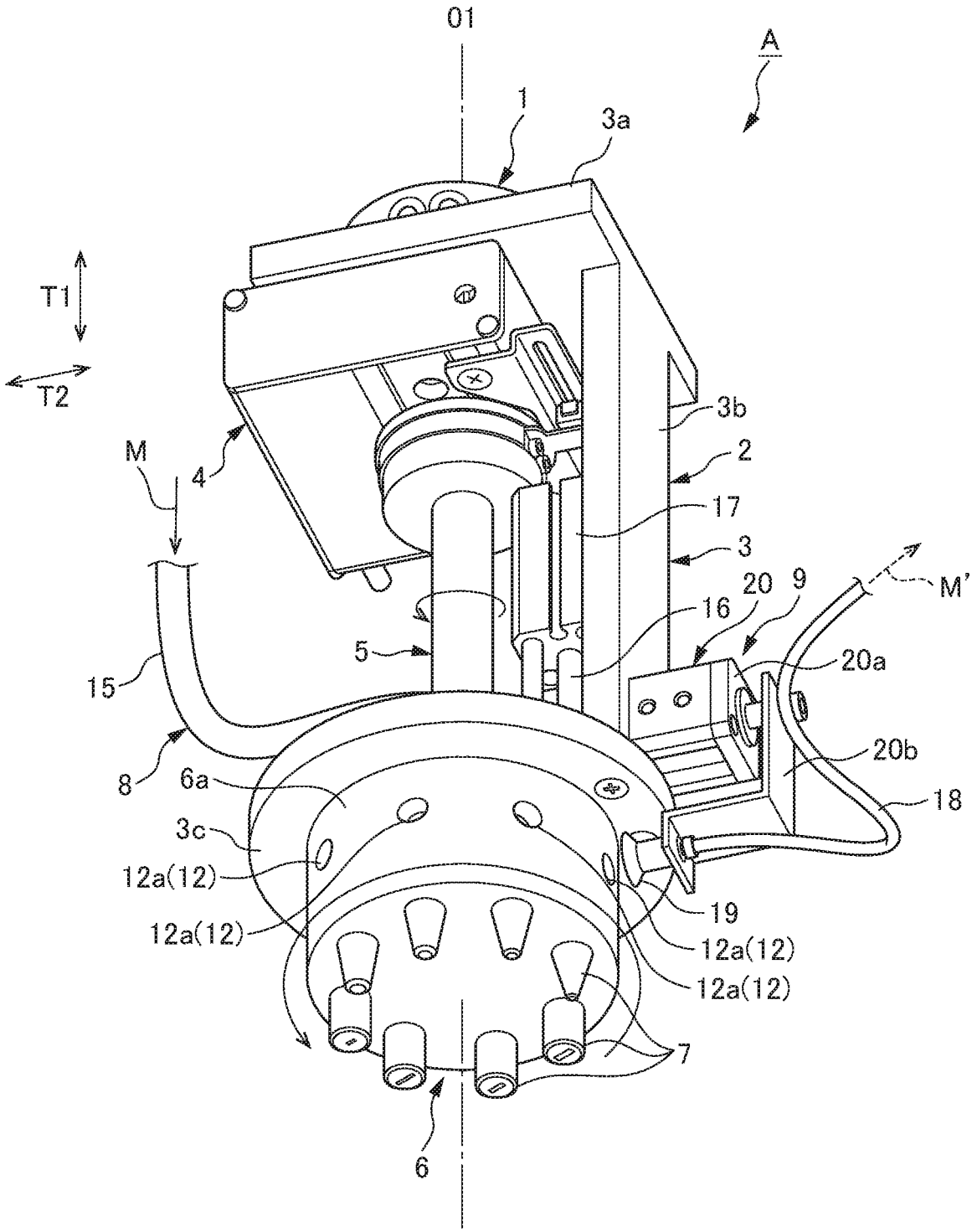
FIG. 2 is a perspective view showing the discharge apparatus according to the embodiment, as viewed from below.

Specifically, as shown in FIGS. 1 and 2, the discharge apparatus A of the present embodiment includes a connecting unit 1 via which attachment to and detachment from a robot hand or the like of an industrial robot is implemented, and a discharge apparatus body 2.

For example, the connecting unit 1 is provided integrally with an upper end of the discharge apparatus body 2. As the connecting unit 1, an automatic tool changer (ATC) is used which can be smoothly attached to/detached from the robot hand, and which can be smoothly replaced. The connecting unit 1 does not necessarily have to be embodied as the ATC, provided that the connecting unit 1 allows the discharge apparatus A to be connected to and supported on a desired component or part.

The discharge apparatus body 2 of the present embodiment includes: a frame 3; a rotary drive 4, such as a rotary actuator, supported on the frame 3; a rotary shaft 5 that has an upper end connected to the rotary drive 4 and is rotated about an axis O1 extending in a vertical direction T1 when driven by the rotary drive 4; a nozzle head 6 that is connected to, and supported on, a tip end of the rotary shaft 5; discharge nozzles 7 attachable to the nozzle head 6; a discharge material supply unit 8 for feeding a discharge material M to the discharge nozzles 7; and a discharge material removal unit 9 for removing a remainder M' of the fed discharge material.

The frame 3 includes, for example: a support part 3*a* that is provided in an upper end portion of the frame 3, is formed in a substantially square plate shape, and has an upper surface supporting the connecting unit 1 integrally attached thereto and a lower surface supporting the rotary drive 4 integrally attached thereto; a pillar part 3*b* that is formed in a substantially rectangular strip-plate shape, has an upper end connected to a lateral end of the support part 3*a*, and extends downward along the axis O1; and a bearing board part 3*c* that is formed in a substantially disc shape, is connected to a lower end of the pillar part 3*b* and arranged to lie in a lateral direction T2 orthogonal to the axis O1, and pivotably supports the lower end portion of the rotary shaft 5 passing through a central hole 3*d*.

In addition, as shown in FIG. 1 (and FIG. 4), the bearing board part 3*c* has, at a predetermined position, a delivery nozzle insertion hole 10 that penetrates the bearing board part 3*c* from the upper surface to the lower surface thereof.

As shown in FIGS. 1 to 5, the nozzle head 6 is formed in a substantially disc shape (or a substantially columnar shape), has an upper surface facing the lower surface of the bearing board part 3*c*, and is arranged to be integrally connected to the lower end portion of the rotary shaft 5 passing through the central hole 3*d* such that the nozzle head 6 and the rotary shaft 5 are coaxial with each other. Thus, the nozzle head 6 can be rotated about the axis O1, together with the rotary shaft 5 when the rotary drive 4 is driven.

The nozzle head 6 has a plurality of feeding channels 11 that penetrate the nozzle head 6 from the upper surface to the lower surface thereof. In the nozzle head 6 of the present embodiment, eight feeding channels 11 extending along the axis O1 are arranged at regular intervals in a circumferential direction with respect to the axis O1 set as the center point, i.e., on the circumference of a circle centered about the axis O1. Each feeding channel 11 has a female thread formed in a portion of the inner surface thereof, the portion being adjacent to the lower end of the feeding channel 11. Note that the feeding channels 11 may be arranged at an interval in a radial direction with respect to the axis O1 set as the center point. The number and arrangement of the feeding channels 11 may be appropriately determined, as long as the at least two feeding channels 11 are provided.

The nozzle head 6 is provided with removal channels 12 each of which communicates with an associated one of the feeding channels 11 via an end of the removal channel 12 connected to the associated feeding channel 11. Each removal channel 12 extends in a radial direction with respect to the axis O1 as the center point, and has an opening in an outer peripheral surface (outer surface) 6*a*. Specifically, the nozzle head 6 of the present embodiment has eight openings 12*a* of the eight removal channels 12 that communicate with the eight feeding channels 11, the eight openings 12*a* being formed in the outer peripheral surface 6*a*, and arranged at regular intervals in the circumferential direction with respect to the axis O1 as the center point.

Figure 3:
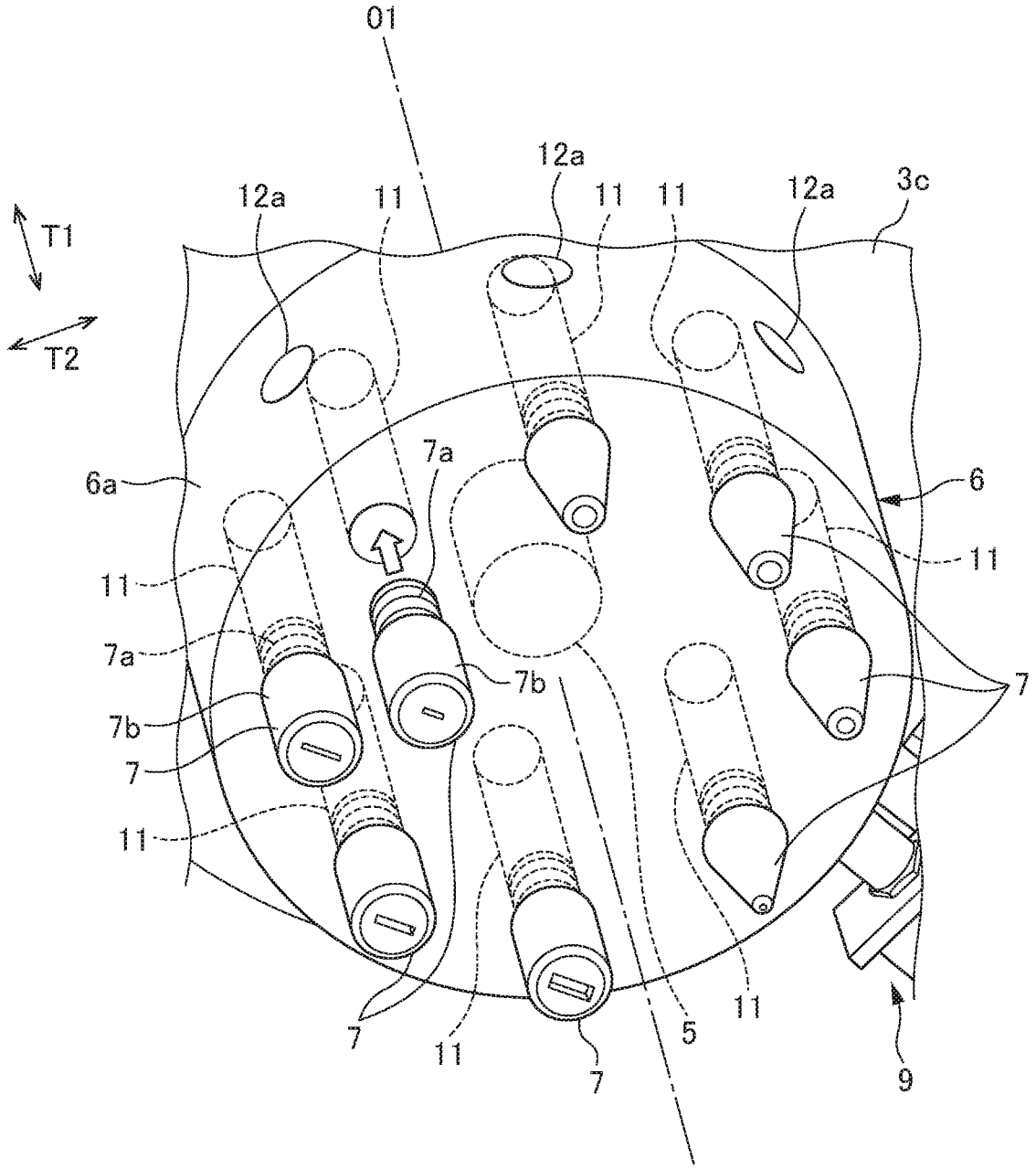
FIG. 3 is a perspective view showing a nozzle head and discharge nozzles of the discharge apparatus according to the embodiment, as viewed from below.
Figure 5:
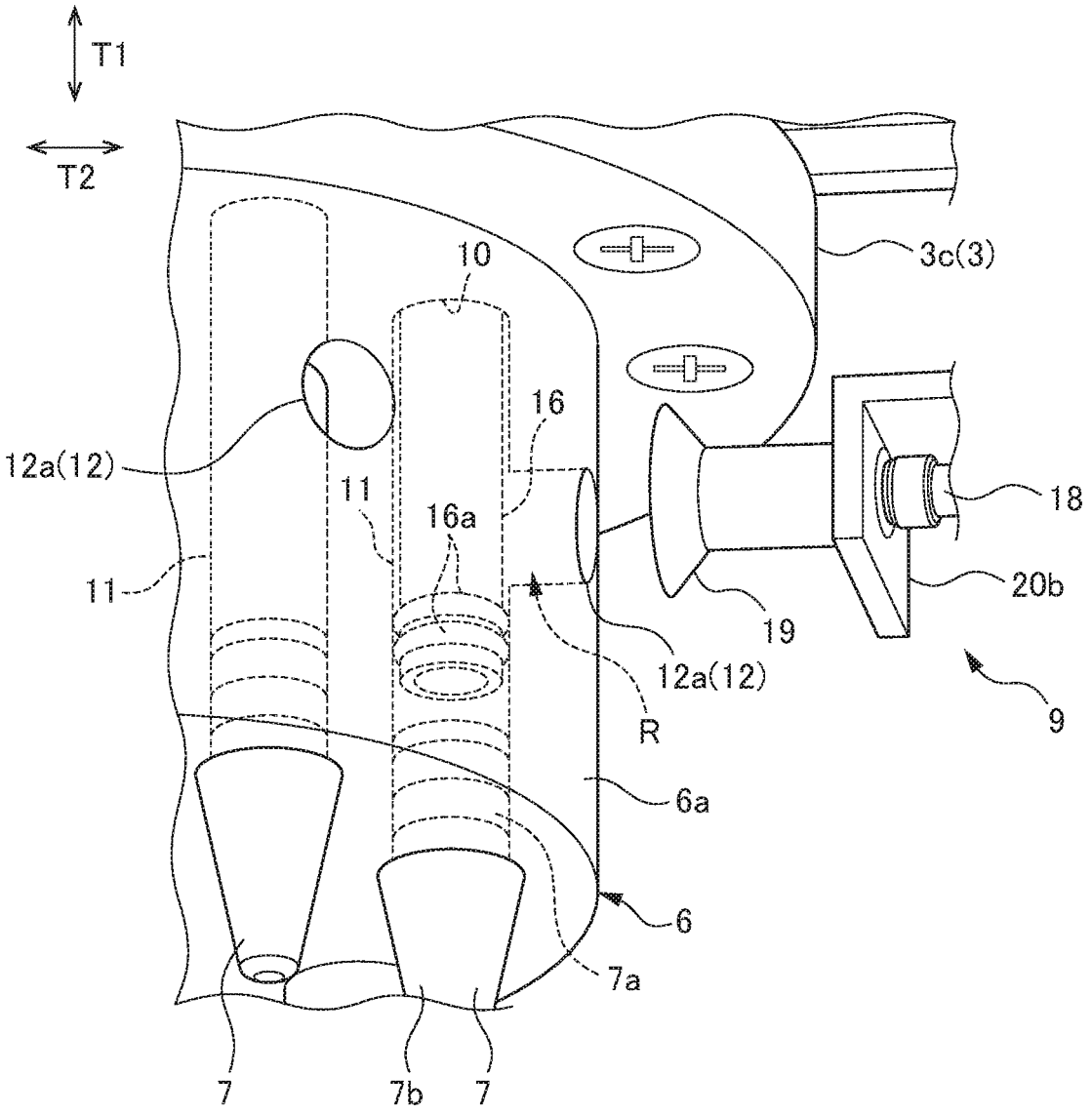
FIG. 5 is a perspective view showing the discharge apparatus according to the embodiment as viewed from below, in a state where the delivery nozzle is positioned at the first position.

As shown in FIGS. 3 and 5, the discharge nozzle 7 includes: a joint part 7*a* that is configured to be detachably attached by being inserted into the feeding channel 11 through an opening of the feeding channel 11 formed in the lower surface of the nozzle head 6; and a nozzle body 7*b* that is arranged to project downward from the lower surface of the nozzle head 6.

The joint part 7*a* of the discharge nozzle 7 has a male thread formed thereon. The joint part 7*a* is engaged with the female thread formed on the lower portion of the feeding channel 11, so that the discharge nozzle 7 is detachably attached to the nozzle head 6, while being connected to, and communicating with, the feeding channel 11. In addition, in the present embodiment, since the nozzle head 6 is provided with the eight feeding channels 11, the discharge nozzles 7 of different types are each attached to an associated one of the feeding channels 11 in a selective manner.

As shown in FIGS. 1, 2, 4 and 5, the discharge material supply unit 8 includes, for example: a feeding tube 15 through which the discharge material M is fed as a pump or the like is driven; a tubular delivery nozzle (delivery tube) 16 that is connected to an end of the feeding tube 15 and insertable into the delivery nozzle insertion hole 10 of the bearing board part 3*c*; and a delivery nozzle reciprocating drive (delivery tube reciprocating drive) 17. The delivery nozzle reciprocating drive 17 reciprocates the delivery nozzle 16 in the vertical direction T1 inside the delivery nozzle insertion hole 10 and the feeding channel 11 that is positioned below and communicates with the delivery nozzle insertion hole 10.

The delivery nozzle 16 has, on a lower end (distal end) thereof, a sealing member (sealing part) 16*a* such as an O-ring. Thus, in a state where the delivery nozzle 16 has been inserted and fitted into the feeding channel 11, the sealing member 16*a* is in contact with the inner surface of the feeding channel 11 without leaving any gap therebetween, thereby preventing the discharge material M and air from leaking between the inner surface of the feeding channel 11 or other components and the outer surface of the delivery nozzle 16.

Figure 6:
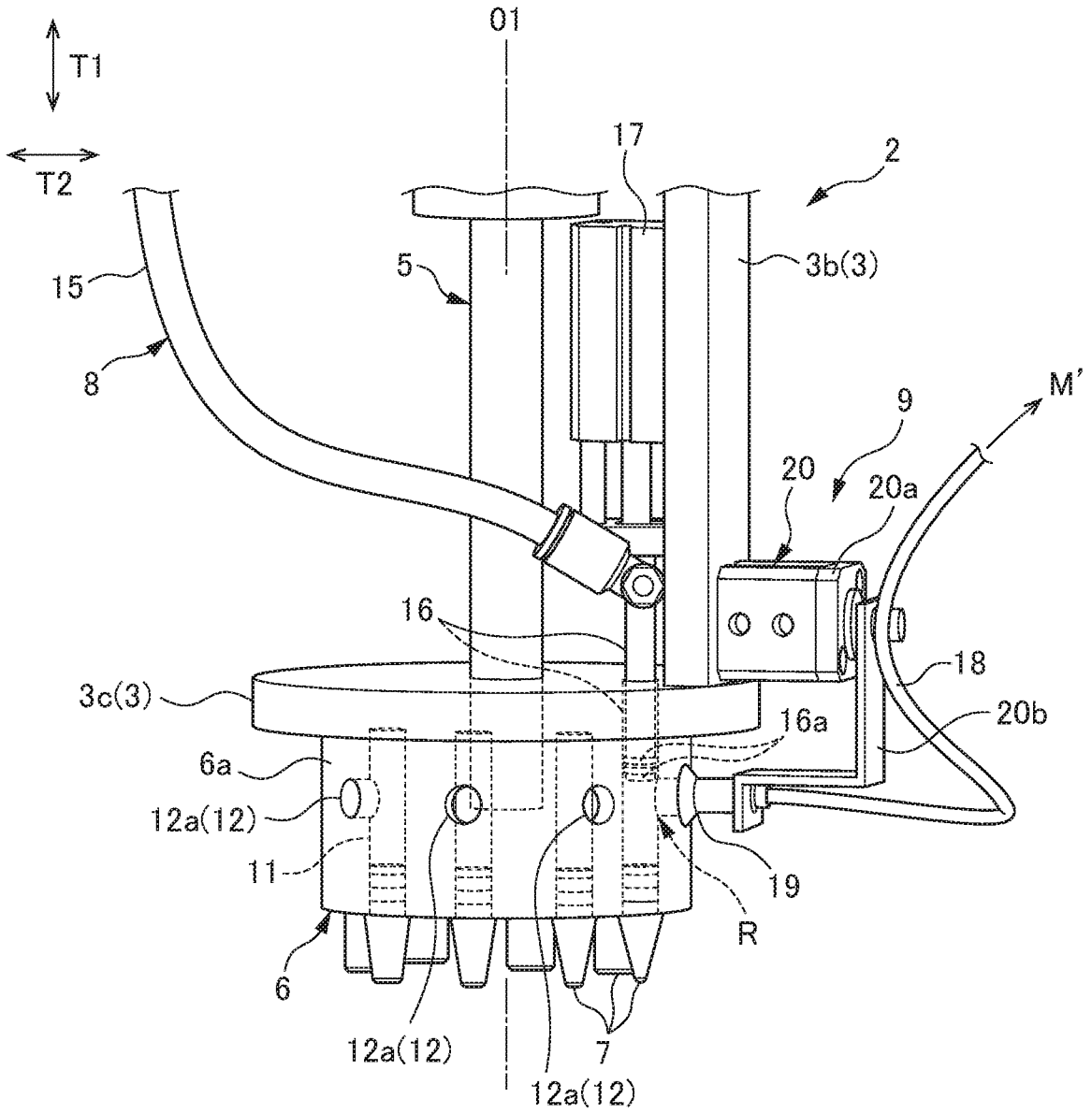
FIG. 6 shows the discharge apparatus according to the embodiment, in a state where the delivery nozzle is positioned at a second position and a suction pad sticks to the nozzle head.

The delivery nozzle reciprocating drive 17 includes a cylinder or the like that reciprocates in the vertical direction T1 by being driven by, for example, supply and exhaust of compressed air. The delivery nozzle reciprocating drive 17 can adjust, by driving the cylinder or the like, the position of the distal end (sealing member 16*a*) of the delivery nozzle 16 between: a first position at which the distal end of the delivery nozzle 16 is inserted and fitted in the feeding channel 11 so as to be closer to the discharge nozzle than a coupling portion R of the feeding channel 11 and the removal channel 12 is, as shown in FIGS. 4 and 5; a second position at which the distal end of the delivery nozzle 16 is inserted and fitted in a portion of the feeding channel 11 located above the coupling portion R of the feeding channel 11 and the removal channel 12, as shown in FIG. 6; and a third position at which the distal end of the delivery nozzle 16 is out of the feeding channel 11 by having been pulled out, as shown in FIGS. 7 and 8.

Figure 4:
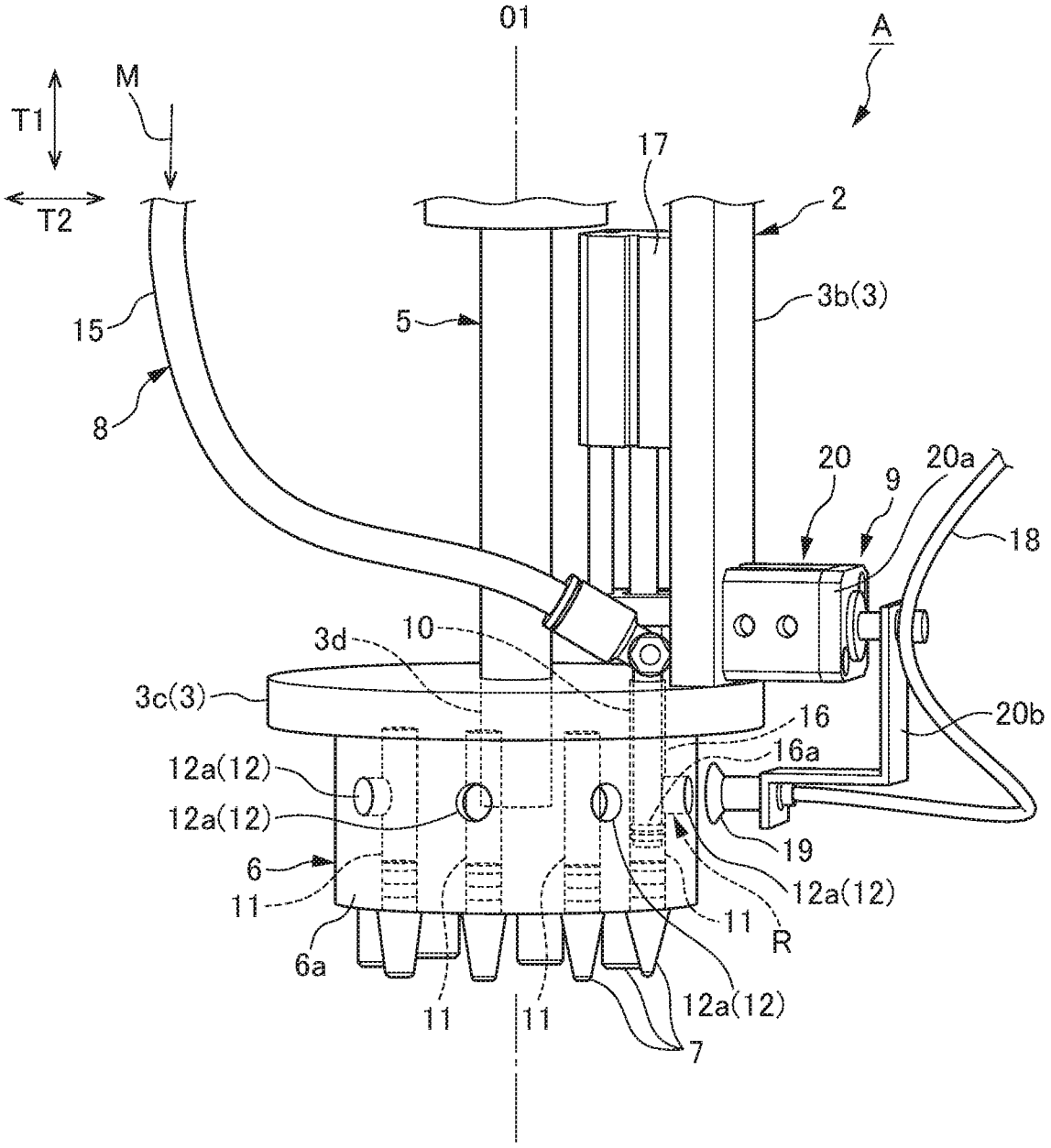
FIG. 4 shows the discharge apparatus according to the embodiment, in a state where a delivery nozzle is positioned at a first position.

The first position shown in FIGS. 4 and 5 is a discharge position of the delivery nozzle 16 at which the discharge material M fed through the feeding tube 15 is discharged from the discharge nozzle 7 so that the discharge material M is applied to a workpiece, for example.

At the second position of the delivery nozzle 16 shown in FIG. 6, the removal channel 12 communicates with a lower portion of the feeding channel 11 located below the coupling portion R (a portion adjacent to the discharge nozzle 7) while the sealing member 16*a* disconnects the removal channel 12 from a portion of the feeding channel 11 adjacent to the bearing board part 3*c*, and the discharge material removal unit 9 to be detailed later causes a suction force to act through the opening 12*a* of the removal channel 12 so that the remainder M' of the discharge material remaining in the discharge nozzle 7 and the portion of the feeding channel 11 adjacent to the discharge nozzle 7 is sucked and removed to the outside through the removal channel 12.

Figure 7:
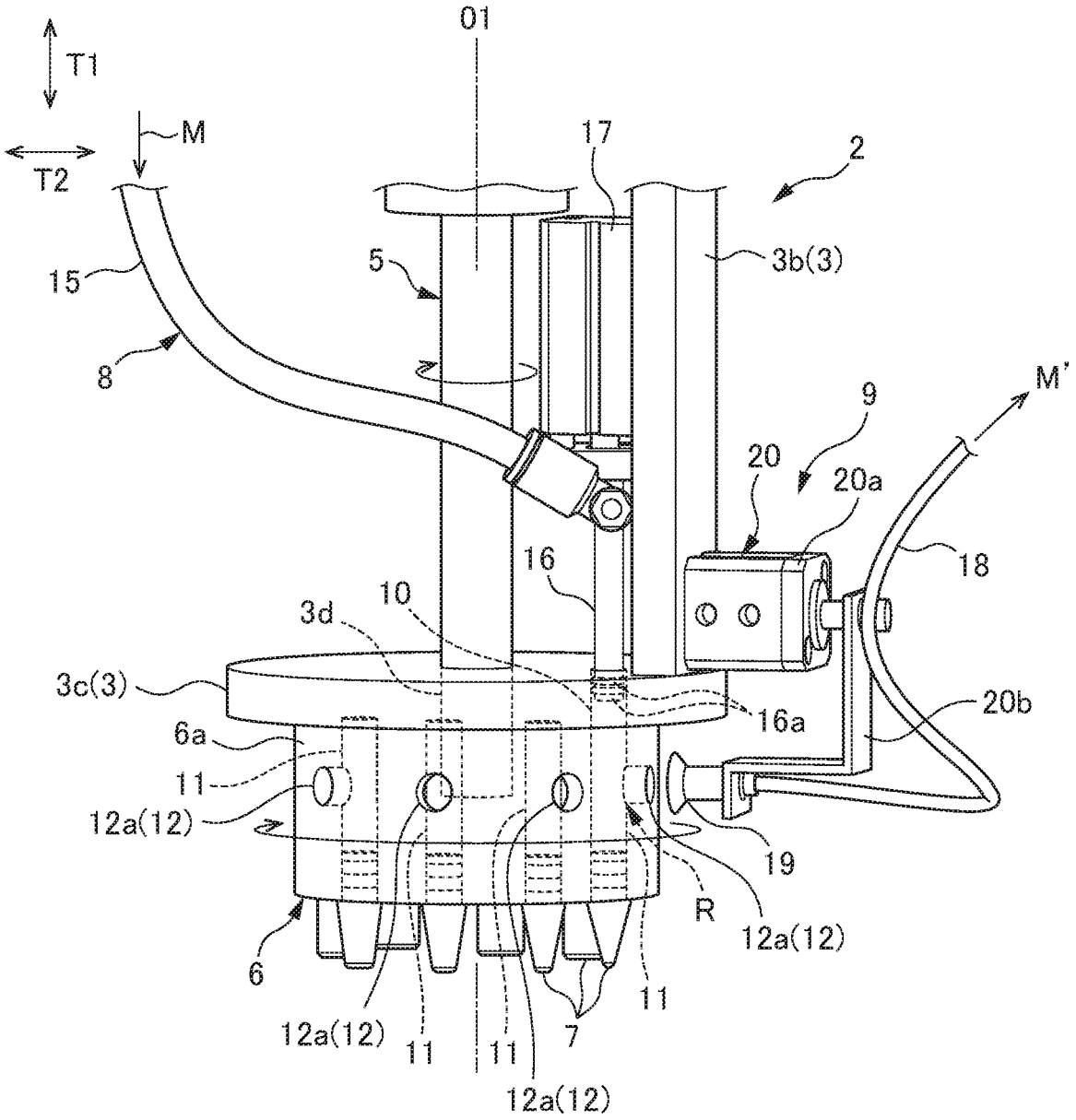
FIG. 7 shows the discharge apparatus according to the embodiment, in a state where the delivery nozzle is positioned at a third position.
Figure 8:
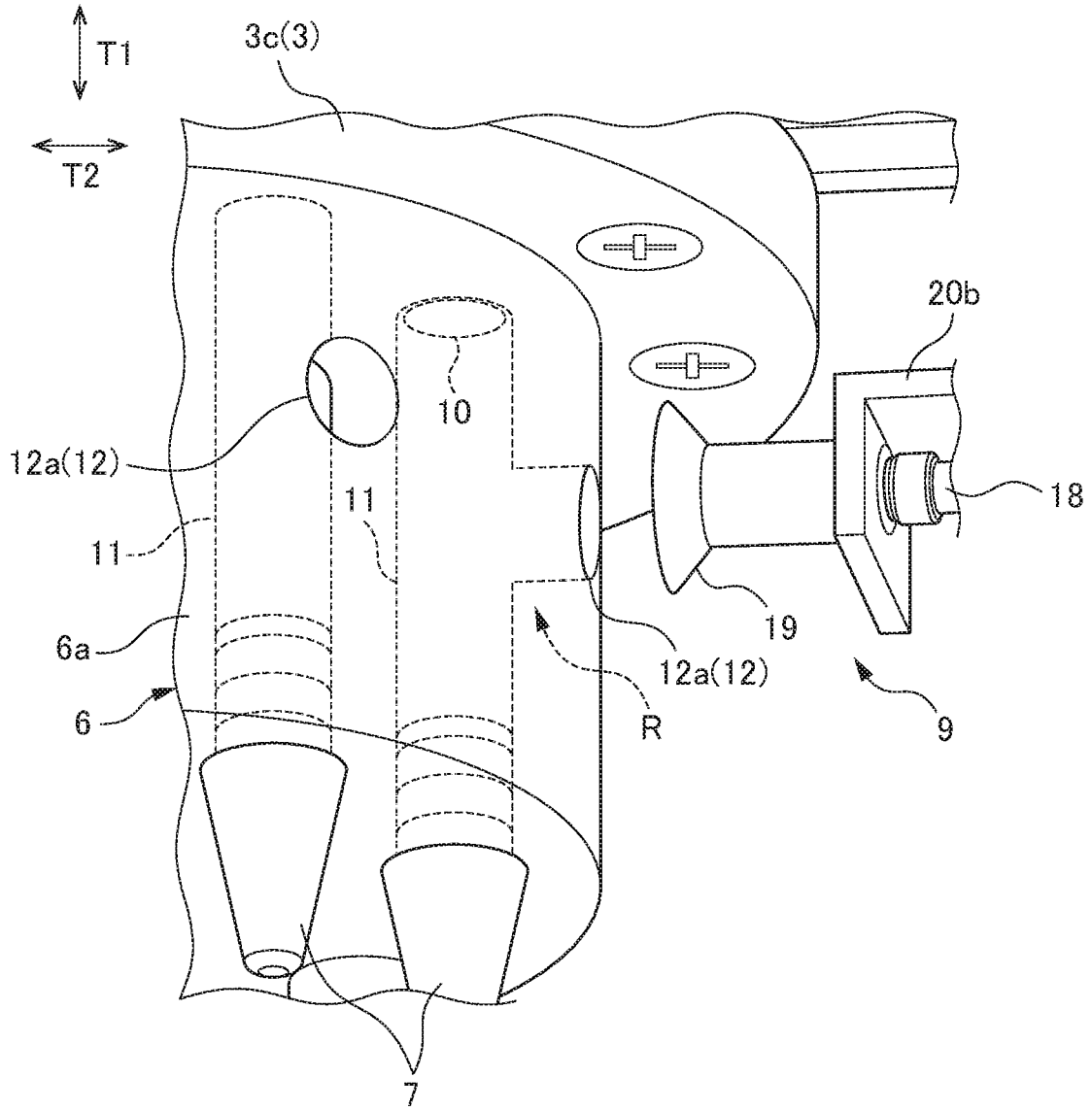
FIG. 8 is a perspective view showing the discharge apparatus according to the embodiment as viewed from below, in a state where the delivery nozzle is positioned at the third position.

At the third position of the delivery nozzle 16 shown in FIGS. 7 and 8, the sealing member 16*a* provided at the distal end of the delivery nozzle 16 is within the thickness of the bearing board part 3*c*, i.e., inside the delivery nozzle insertion hole 10, and the nozzle head 6 can be rotated by the rotation of the rotary shaft 5. The third position is a switching position of the delivery nozzle 16 at which another feeding channel 11 and another discharge nozzle 7 are prepared to discharge the discharge material M, in other words, at which switching from one discharge nozzle 7 to another is automatically performed, or at which the discharge operation is completed.

The third position may be defined as, but is not limited to, a position at which the delivery nozzle 16 is completely pulled out of the bearing board part 3*c*. Setting the third position as a position at which the distal end of the delivery nozzle 16 is within the thickness of the bearing board part 3*c* can eliminate the need to insert the delivery nozzle 16 again into the delivery nozzle insertion hole 10 of the bearing board part 3*c*, and can avoid an inconvenient situation in which, for example, an axial deviation prevents the delivery nozzle 16 from being properly inserted into the delivery nozzle insertion hole 10 of the bearing board part 3*c*.

Next, reference is made to FIGS. 1, 2 and 4 to 8. The discharge material removal unit 9 includes: a suction tube 18 connected to a suction means (not shown) such as a vacuum pump; a suction pad 19 attached to an end of the suction tube 18; a suction pad reciprocating drive (suction tube reciprocating drive) 20 reciprocating the suction pad 19 in a lateral direction T2 facing the outer peripheral surface 6*a* of the nozzle head 6.

The suction pad 19 is in a cylindrical shape and includes a suction surface having a central hole that communicates with the suction tube 18 connected to the suction pad 19.

For example, the suction pad reciprocating drive 20 is attached to the pillar part 3*b* of the frame 3, and includes: a reciprocating drive part 20*a* such as a cylinder that extends and retracts in a lateral direction T2 in the radial direction with respect to the axis O1 as the center point; and a holder member 20*b* having one end connected to, for example, a piston of the cylinder as the reciprocating drive part 20*a*, and extending downward to hold the suction pad 19 and the end portion of the suction tube 18.

As shown in FIGS. 1 and 6, in the discharge material removal unit 9, the reciprocating drive part 20*a* retracts radially inwardly so as to move the holder member 20*b* and the suction pad 19 radially inwardly toward the outer peripheral surface 6*a* of the nozzle head 6, so that the suction pad 19 sticks to the outer peripheral surface 6*a* of the nozzle head 6 while the opening 12*a* at a predetermined position communicates with the suction tube 18 via the suction pad 19.

On the other hand, as shown in FIGS. 7 and 8 (and FIGS. 2, 4 and 5), when the reciprocating drive part 20*a* extends radially outwardly to cause the holder member 20*b* and the suction pad 19 to retract radially outwardly away from the outer peripheral surface 6*a* of the nozzle head 6, the suction pad 19 separates from the outer peripheral surface 6*a* of the nozzle head 6.

In the discharge apparatus A of the present embodiment having the above-described configuration, the discharge nozzles 7 as desired are screwed into the plurality of feeding channels 11 of the nozzle head 6. The connecting unit 1 is connected to, for example, a robot hand provided at an end of an arm of an industrial robot, whereby the discharge apparatus A is attached to the arm of the robot. At this time, the discharge apparatus A disposed at a predetermined position may be automatically connected to the arm through driving and controlling the robot. It is also conceivable that the discharge nozzle 7 as desired is automatically attached to the feeding channel 11 at a desired position of the nozzle head 6.

Next, the rotary drive 4 is driven to rotate and position the rotary shaft 5 and the nozzle head 6 such that the feeding channel 11 to which the discharge nozzle 7 to be used is attached communicates with the delivery nozzle insertion hole 10 formed in the bearing board part 3*c*.

At the same time, the delivery nozzle reciprocating drive 17 is driven so that the delivery nozzle 16 is inserted and fitted to reach the first position in the feeding channel 11, that is, the position where the sealing member 16*a* is in a portion of the feeding channel 11, the portion being closer to the discharge nozzle 7 than the coupling portion R of the feeding channel 11 and the removal channel 12 is, as shown in FIGS. 2, 4 and 5. While this state is maintained, driving the pump or the like of the discharge material supply unit 8 causes the discharge material M to be fed through the feeding tube 15 to the delivery nozzle 16, the feeding channel 11 and the discharge nozzle 7, from which the discharge material M is discharged.

At this time, since the feeding channel 11 through which the discharge material M is fed is disconnected from the removal channel 12 by the sealing member 16*a* of the delivery nozzle 16, the discharge material M can be suitably discharged from the discharge nozzle 7. The discharge material M can be, for example, applied to a workpiece through driving and controlling the robot.

Next, after completion of the application or the like of the discharge material M from the selected discharge nozzle 7, if the application is finished or if the application of the discharge material M is to be continued using another discharge nozzle 7, the delivery nozzle reciprocating drive 17 is first driven, the delivery nozzle 16 is moved upward to the second position in the feeding channel 11 as shown in FIGS. 1 and 6, i.e., the position at which the sealing member 16*a* is positioned in a portion of the feeding channel 11, the portion being located above the coupling portion R of the feeding channel 11 and the removal channel 12 and being adjacent to the bearing board part 3*c*.

At the same time, the reciprocating drive part 20*a* of the discharge material removal unit 9 is driven such that the suction pad 19 is caused to stick to the outer peripheral surface 6*a* of the nozzle head 6. At this time, since the position of the nozzle head 6 is controlled, the suction pad 19 automatically sticks to a position at which the opening 12*a* formed in the outer peripheral surface 6*a* of the nozzle head 6 communicates with the suction tube 18 via the suction pad 19.

At this stage, the suction means, such as a vacuum pump, of the discharge material removal unit 9 is driven, so that the remainder M' of the discharge material remaining in the discharge nozzle 7 and the feeding channel 11 is sucked to the outside through the removal channel 12, the suction pad 19 and the suction tube 18. Thus, the remainder M' of the discharge material can be removed automatically, and drips of the discharge material or the like can be prevented.

Next, the reciprocating drive part 20*a* of the discharge material removal unit 9 is driven so that the suction pad 19 is retracted from the outer peripheral surface 6*a* of the nozzle head 6 to release the suction pad 19 from the sticking state, as shown in FIGS. 2, 7 and 8.

Along with this, the delivery nozzle 16 is moved upward to the third position at which the distal end of the delivery nozzle 16 is positioned within the thickness of the bearing board part 3*c* (inside the delivery nozzle insertion hole 10), whereby the delivery nozzle 16 is pulled out of the feeding channel 11 to be separated from the nozzle head 6. Thus, bringing the delivery nozzle 16 into the third position at which the delivery nozzle 16 is separated from the nozzle head 6 allows the nozzle head 6 to be rotated.

If another discharge nozzle 7 is used next to, for example, continue applying the discharge material M, the nozzle head 6 is rotated such that the feeding channel 11 having the next-to-be-used discharge nozzle 7 attached thereto communicates with the delivery nozzle insertion hole 10 of the bearing board part 3*c*, resulting in that the feeding channel 11 having the next-to-be-used discharge nozzle 7 attached thereto is positioned immediately under the delivery nozzle 16. Rotating the nozzle head 6 in this manner automatically brings the opening 12*a* of the removal channel 12 that communicates with the feeding channel 11 having the next-to-be-used discharge nozzle 7 attached thereto into the predetermined position facing the suction pad 19.

While this state is maintained, when the delivery nozzle 16 is moved downward to reach the first position in the feeding channel 11, the new discharge nozzle 7 becomes ready to discharge the discharge material M. When the delivery nozzle 16 is moved upward to the second position, and suction is performed via the sticking suction pad 19, the remainder M' of the discharge material remaining in the new discharge nozzle 7 and the feeding channel 11 can be removed.

Thus, in the discharge apparatus A (and the industrial robot) according to the present embodiment, the nozzle head 6 is provided with the plurality of feeding channels 11 through which the discharge material M in a liquid, solid or gaseous form is fed, and is rotatable about the axis O1, and the discharge nozzles 7 are detachably attached to the feeding channels 11. Rotating the nozzle head 6 allows the delivery nozzle 16 to be automatically inserted to reach the first position in the feeding channel 11, to which the discharge nozzle 7 to be used is attached and which has been brought into a predetermined position, thereby achieving the connection between the delivery nozzle 16 and the feeding channel 11.

As can be seen, when the discharge material M is going to be applied, the nozzle head 6 is controlled and positioned such that the feeding channel 11, to which the discharge nozzle 7 to be used is attached is brought into the predetermined position, and the delivery nozzle 16 is automatically inserted. This feature makes it possible to freely and quickly select the most appropriate one from the discharge nozzles 7, and to discharge the discharge material M.

In addition, the removal channels 12 are provided which communicate with the feeding channels 11. The delivery nozzle 16 is moved to the second position above the coupling portion R of the feeding channel 11 and the removal channel 12, and the suction is performed via the suction pad 19 sticking to the outer peripheral surface 6*a* of the nozzle head 6, whereby the remainder M' of the discharge material remaining in the discharge nozzle 7 and the feeding channel 11 can be removed to the outside through removal channel 12, the suction pad 19 and the suction tube 18.

This relatively simple structure can automatically remove the remainder M' of the discharge material remaining in the discharge nozzle 7 and the feeding channel 11. Further, the relatively simple structure enables costs reduction, is easy to clean, and can impart a function of preventing drips.

Thus, the discharge apparatus A (and the industrial robot) according to the present embodiment can enhance efficiency in working such as application of a discharge material in a liquid, solid or gaseous form to a workpiece, and can improve the quality of the working. Using the discharge apparatus according to the present embodiment alone makes it possible to achieve automation of application of discharge materials in more various forms to various types of workpieces, while eliminating the need to provide two or more apparatuses. The discharge apparatus A enables cost reduction and has enhanced maintainability.

In the foregoing, the embodiment of the discharge apparatus and the industrial robot according to the present disclosure have been described. However, the present disclosure is not limited to the embodiment described above, and modifications may be appropriately made without deviating from the spirit of the present disclosure.

For example, a removal channel 12 may be formed to communicate with two or more feeding channels 11. In this case, the suction is performed through the opening 12*a* of the removal channel 12 so that the remainder M' of the discharge material can be sucked and removed from the feeding channels 11 and discharge nozzles 7 attached thereto at the same time.

The shape of the nozzle head 6, the number of the feeding channels 11, and the number of the attachable discharge nozzles 7 do not need to be particularly limited. In the embodiment described above, the direction in which the discharge nozzle discharges the discharge material corresponds to the downward direction, while the opposite direction corresponds to the upward direction. However, the present disclosure is not limited thereto. The discharge nozzle may discharge the discharge material in an obliquely downward direction, a lateral direction, an obliquely upward direction, or an upward direction.

EXPLANATION OF REFERENCE NUMERALS

1: Connecting Unit
2: Discharge Apparatus Body
3: Frame
3*c*: Bearing Board Part
5: Rotary Shaft
6: Nozzle Head
6*a*: Outer Peripheral Surface (Outer Surface)
7: Discharge Nozzle
8: Discharge Material Supply Unit
9: Discharge Material Removal Unit
10: Delivery Nozzle Insertion Hole
11: Feeding Channel

12: Removal Channel
12*a*: Opening
16: Delivery Nozzle (Delivery Tube)
16*a*: Sealing Member (Sealing Part)
17: Delivery Nozzle Reciprocating Drive (Delivery Tube Reciprocating Drive)
18: Suction Tube
19: Suction Pad
20: Suction Pad Reciprocating Drive (Suction Tube Reciprocating Drive)
20*a*: Reciprocating Drive Part
A: Discharge Apparatus
M: Discharge Material
M': Remainder of Discharge Material
O1: Axis
T1: Vertical Direction
T2: Lateral Direction

What is claimed is:

1. A discharge apparatus comprising:

a nozzle head having a plurality of feeding channels for feeding a discharge material, and a plurality of removal channels each communicating with one of the plurality of feeding channels and usable for removing a remainder of the discharge material remaining in the one of the plurality of feeding channels;

a plurality of discharge nozzles configured to be attached to the nozzle head such that each of the plurality of discharge nozzles is connected to an associated one of the plurality of feeding channels;

a delivery tube configured to deliver the discharge material selectively to one of the plurality of feeding channels so that the discharge material is discharged from one of the plurality of discharge nozzles; and a suction tube connectable to each of the plurality of removal channels selectively and usable for sucking the remainder of the discharge material remaining in one of the plurality of feeding channels and a respective one of the plurality of discharge nozzles through one of the plurality of removal channels.

2. The discharge apparatus according to claim 1, wherein the suction tube is provided with a suction pad that establishes communication between the suction tube and one of the plurality of removal channels by sticking to an outer surface of the nozzle head.

3. The discharge apparatus according to claim 1, wherein the delivery tube is provided with a sealing part that blocks between an inner surface of one of the plurality of feeding channels and an outer surface of the delivery tube in a state where the delivery tube has been inserted in the one of the plurality of feeding channels, when the discharge material is discharged from one of the plurality of discharge nozzles, the delivery tube is positioned at a first position at which the sealing part is positioned forward in a discharge direction of the one of the plurality of discharge nozzles with respect to a coupling portion of one of the plurality of feeding channels and one of the plurality of removal channels, and when the remainder of the discharge material is sucked through the suction tube, the delivery tube is positioned at a second position at which the sealing part is positioned backward in the discharge direction with respect to the coupling portion of one of the plurality of feeding channels and one of the plurality of removal channels.

4. The discharge apparatus according to claim 3, further comprising:

a delivery tube reciprocating drive that reciprocates the delivery tube to position the delivery tube at the first and second positions in one of the plurality of feeding channels.

5. The discharge apparatus according to claim 4, further comprising:

a suction tube reciprocating drive that reciprocates the suction tube to attach and detach the suction tube to and from one of the plurality of removal channels.

6. The discharge apparatus according to claim 5, wherein the nozzle head is rotatable about an axis, and the discharge apparatus is configured such that the nozzle head is rotated in a controlled manner, the delivery tube is selectively inserted into one of the plurality of feeding channels as the delivery tube reciprocating drive is driven, and the suction tube is attached to, or detached from, one of the plurality of removal channels as the suction tube reciprocating drive is driven.

7. An industrial robot comprising:

an arm; and the discharge apparatus according to claim 1, the discharge apparatus being attachable to the arm.

* * * * *